US007490742B2

(12) United States Patent
Yu

(10) Patent No.: US 7,490,742 B2
(45) **Date of Patent: *Feb. 17, 2009**

(54) PERFUME SPRAY HEAD STRUCTURE

(75) Inventor: Yuan-Wen Yu, Chung-Li (TW)

(73) Assignee: Ing Wen Precision Ent. Co., Ltd., Taoyuan Hsien (TW)

( * ) Notice: Subject to any disclaimer, the term of this patent is extended or adjusted under 35 U.S.C. 154(b) by 84 days.

This patent is subject to a terminal disclaimer.

(21) Appl. No.: 11/526,085

(22) Filed: Sep. 25, 2006

(65) Prior Publication Data

US 2008/0073378 A1 Mar. 27, 2008

(51) Int. Cl.
*B67D 5/06* (2006.01)

(52) U.S. Cl. ..... 222/183; 222/519; 222/521; 222/537; 222/548; 222/321.1; 239/302; 239/600

(58) Field of Classification Search ..... 239/302, 239/600, 338, 354, 284.1; 222/183, 519, 222/520, 521, 537, 531, 535, 562, 548, 549, 222/553, 633

See application file for complete search history.

(56) References Cited

U.S. PATENT DOCUMENTS 1,968,316 A * 7/1934 Schmitt ..... 222/153.08
2,837,374 A * 6/1958 Lipman ..... 239/354
2,886,199 A * 5/1959 Lipman ..... 215/317
3,176,883 A * 4/1965 Davis, Jr. ..... 222/633
4,595,002 A * 6/1986 Michaels et al. ..... 128/200.21
4,595,127 A * 6/1986 Stoody ..... 222/135
4,769,137 A * 9/1988 Powell, Jr. ..... 210/139
5,027,986 A * 7/1991 Heinzel et al. ..... 222/402.24
6,616,067 B1 * 9/2003 Hunter ..... 239/338
6,814,267 B2 * 11/2004 Ingram ..... 222/520
6,923,349 B2 * 8/2005 Lou ..... 222/521
7,080,760 B2 * 7/2006 Yu ..... 222/633
7,080,761 B1 * 7/2006 Yu ..... 222/633
2003/0094430 A1 * 5/2003 Stull et al. ..... 215/321
2003/0127467 A1 * 7/2003 Adams et al. ..... 222/153.14

* cited by examiner

*Primary Examiner*—Len Tran
*Assistant Examiner*—Trevor E. McGraw
(74) *Attorney, Agent, or Firm*—Troxell Law Office PLLC

(57) ABSTRACT

A perfume spray head structure generally comprises a main body, a spray nozzle, a gas guide device, and a gas supply tube, wherein the spray nozzle, the gas guide device, and the gas supply tube are pre-assembled together and then coupled with the main body. By the use of the pre-assembled structure, the assembly process can be performed conveniently and the occurrence of displacement can be avoided. In addition, the spray head has gaps formed thereon for passage of gas and perfume liquid. The perfume liquid is sprayed out via the gaps so as to form uniform perfume mists. The perfume spray head structure of the present invention can avoid the occurrence of non-uniform spray mists, which is caused by the displacement of the spray channel.

4 Claims, 5 Drawing Sheets

PERFUME SPRAY HEAD STRUCTURE

FIELD OF THE INVENTION

The present invention relates to a perfume spray head structure that can be assembled easily and that can generate uniform spray mists.

BACKGROUND OF THE INVENTION

In a general perfume bottle, the perfume liquid is sprayed out by the use of a compressible ball. When the gas is squeezed out of a spray nozzle by compressing the compressible ball, the perfume liquid is also sprayed out from the perfume bottle to form mists. However, a spray head of this kind of spraying-type perfume bottle has small components, which are not easily attachable. In addition, when these components are positioned in the main body of the spray head, the phenomenon of displacement occurs easily. Accordingly, it is difficult to perform the assembly process, and the production yield is very poor. In addition, the spray channel is narrow and jammed easily, which causes the formation of non-uniform perfume mists easily.

SUMMARY OF THE INVENTION

It is a primary object of the present invention to provide a new perfume spray head structure, wherein a spray nozzle, a gas guide device, and a gas supply tube are assembled first and then coupled with a main body. This assembled structure is positioned in a horizontal receiving hole of the main body to prevent the occurrence of displacement and overcome the conventional inconvenience in assembly.

It is another object of the present invention to form the gaps that aid the passage of gas and perfume liquid. The perfume liquid is sprayed out via the gaps so as to form uniform perfume mists. The perfume spray head structure of the present invention can avoid the occurrence of channel displacement, which causes the formation of non-uniform spray mists.

BRIEF DESCRIPTION OF THE DRAWINGS

These and other features, aspects and advantages of the present invention will become better understood with regard to the following description, appended claims, and accompanying drawings, wherein:

DETAILED DESCRIPTION OF THE PREFERRED EMBODIMENT

Figure 1:
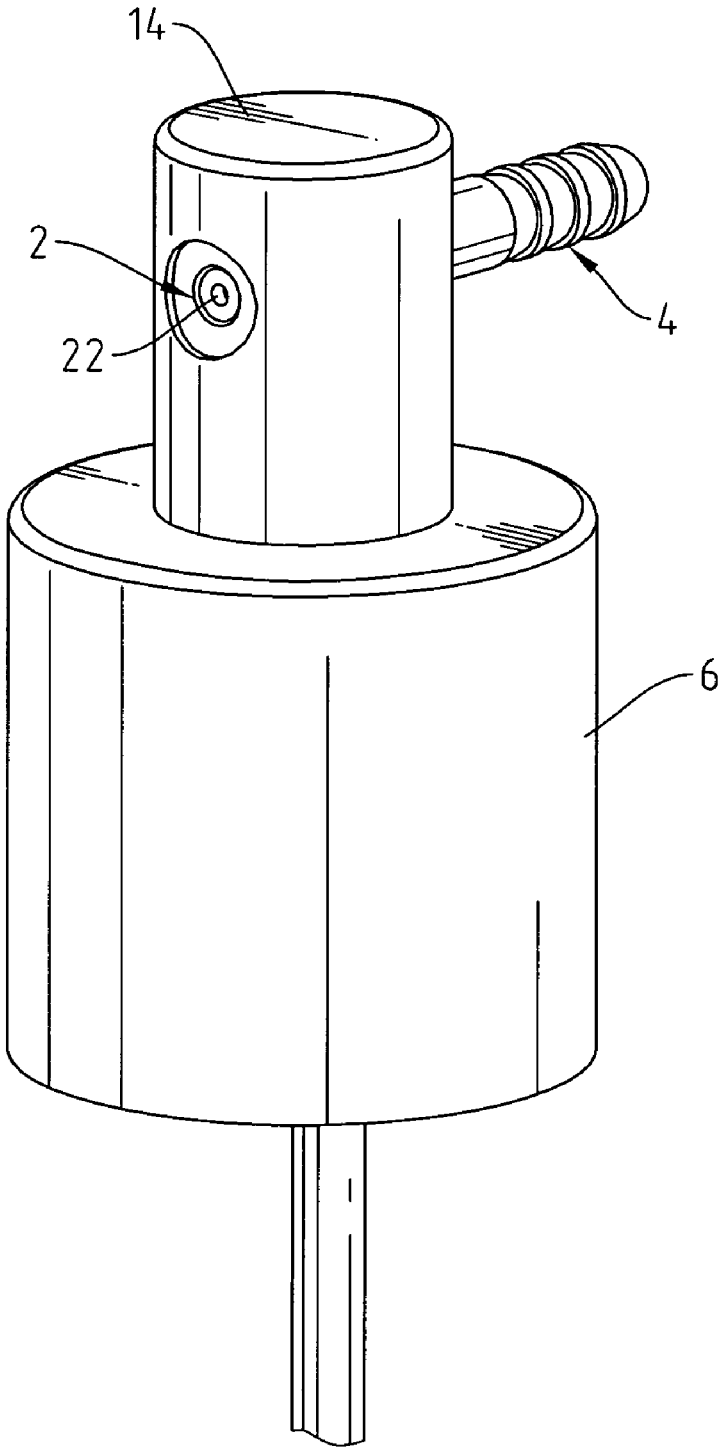
FIG. 1 is an elevational diagram showing the spray head structure of the present invention.
Figure 2:
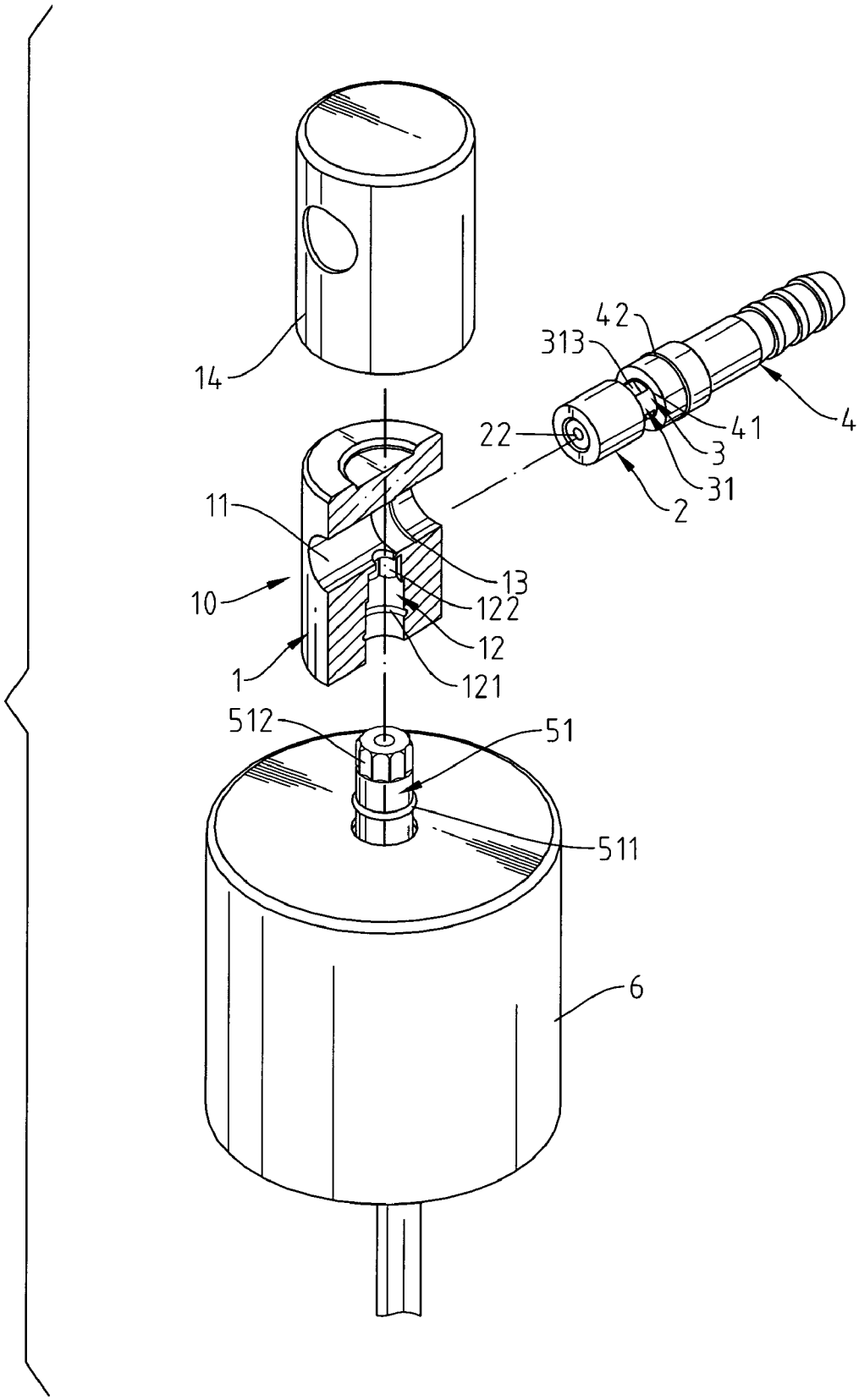
FIG. 2 is an elevational, partial exploded diagram showing the spray head structure of the present invention.
Figure 3:
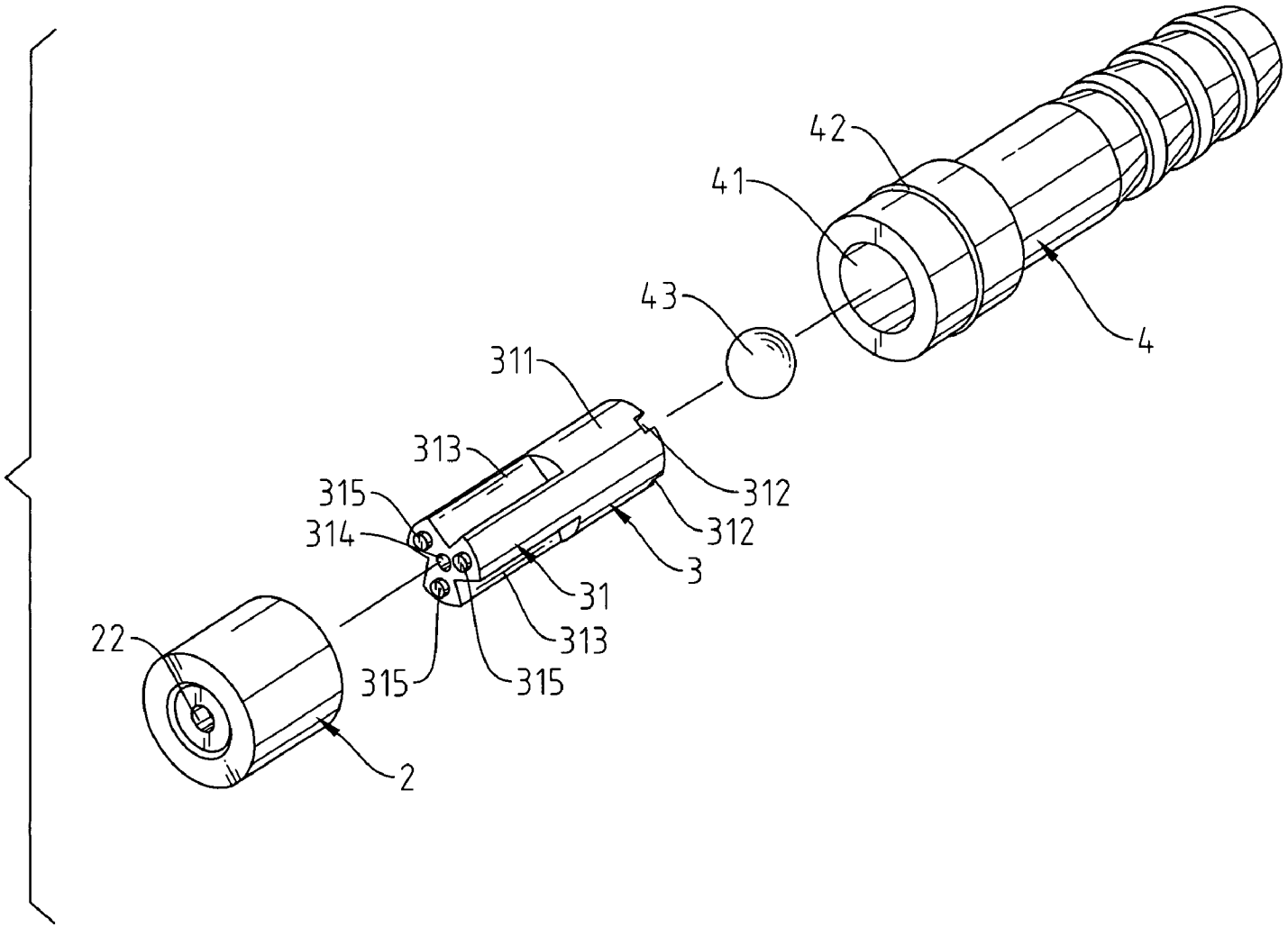
FIG. 3 is an elevational, partial exploded diagram showing the spray head structure of the present invention.

Referring to FIGS. 1 through 3, a perfume spray head structure 10 of the present invention generally comprises a main body 1, a spray nozzle 2, a gas guide device 3, and a gas supply tube 4. The spray nozzle 2, the gas guide device 3, and the gas supply tube 4 are pre-assembled together and then coupled with the main body 1. By the use of the pre-assembled structure, the assembly process can be easily performed and the occurrence of displacement can be avoided.

The aforesaid main body 1 can be sleeved into an outer cover 14. The main body 1 has a horizontal receiving hole 11 and an axial through hole 12 that communicate with each other in a T shape. The horizontal receiving hole 11 is designed for holding and positioning the spray nozzle 2 and the gas supply tube 4 that are assembled together. The gas guide device 3 has a shaft body 31 having a gas hole 314 penetrating through the center thereof. Several notches 312 are formed on the edge of a coupling part 311, which locates on one end of the shaft body 31. Several liquid guide trenches 313 are formed axially on the other end of the shaft body 31. Several bumps 315 are formed on the edge of the shaft body 31 adjacent to the liquid guide trenches 313.

An external compressible ball can be attached to one end of the gas supply tube 4 so as to generate gas for spraying out the perfume liquid. A coupling hole 41 is formed on the other end of the gas supply tube 4. A rolling ball 43 is mounted in the coupling hole 41, and a protrudent ring 42 is formed around the outside of the coupling hole 41.

Figure 4:
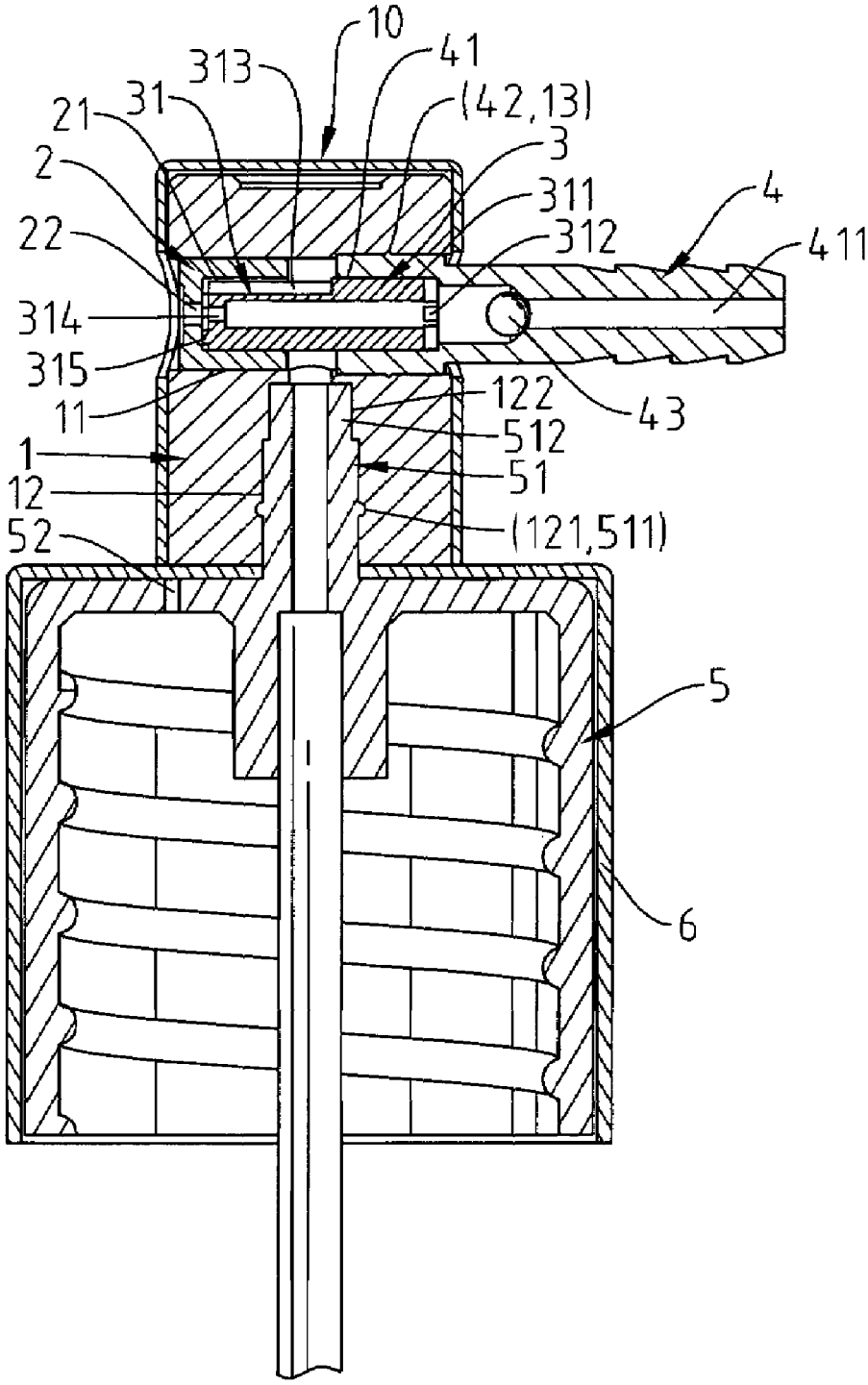
FIG. 4 is a cross-sectional view showing the spray head structure of the present invention.
Figure 5:
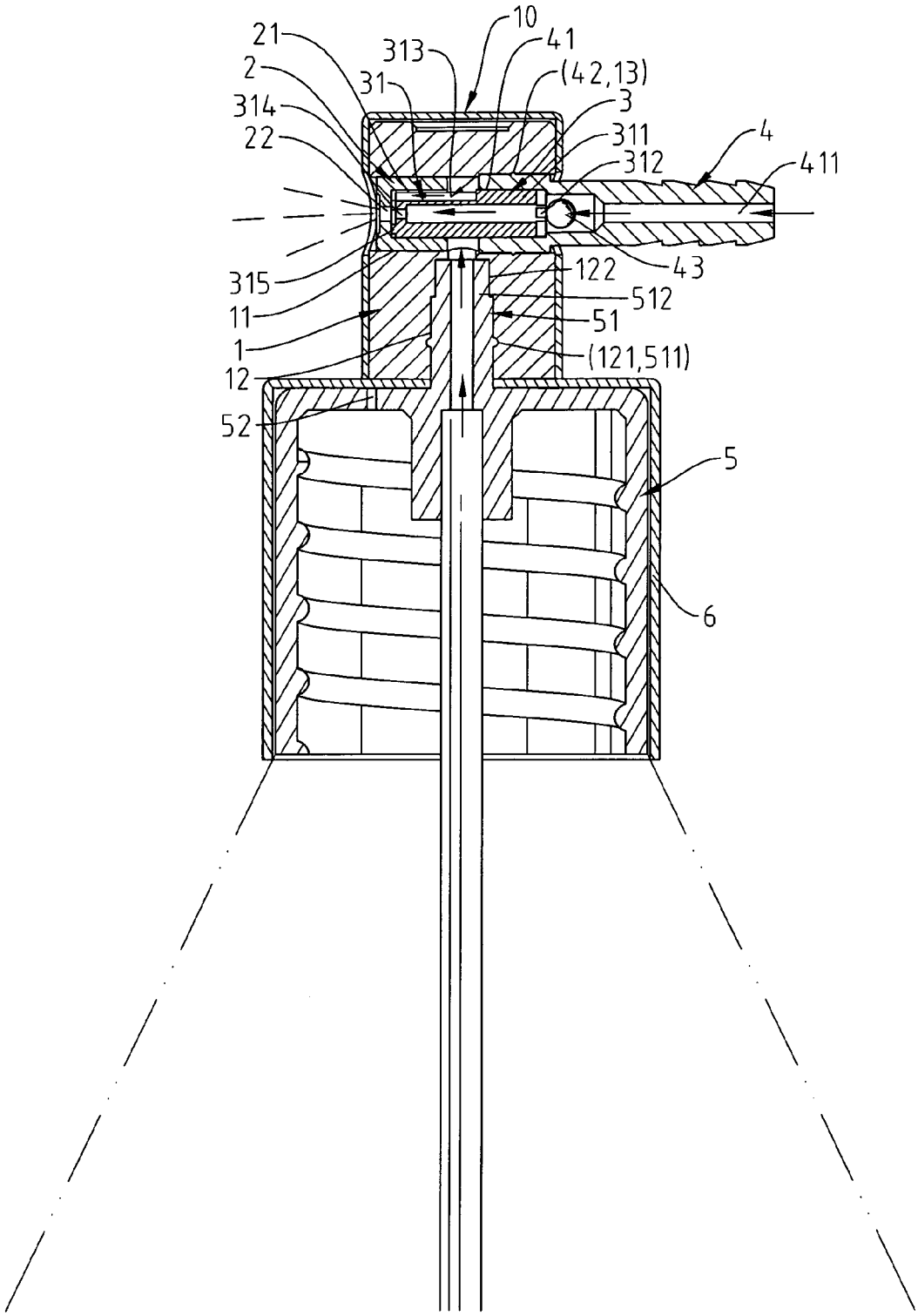
FIG. 5 is a schematic diagram showing the outward spraying status of the mixture of gas and perfume.

Referring to FIG. 4 and FIG. 5, the spray nozzle 2 has a recessed action chamber 21 and a nozzle 22, which communicates with the action chamber 21.

Referring to FIGS. 3 through FIG. 5, when assembling the spray head 10, the coupling part 311 of the gas guide device 3 is inserted into the coupling hole 41 of the gas supply tube 4, and the other end of the shaft body 31 is partially coupled with the inside of the action chamber 21. The liquid guide trenches 313, which are located on the inside of the action chamber 21, can guide the perfume liquid since their partial sections are exposed to the outside and not coupled with the spray nozzle 2 and the gas supply tube 4. After the spray nozzle 2, the gas guide device 3, and the gas supply tube 4 are assembled together, as shown in FIG. 2, they can be positioned in the horizontal receiving hole 11 of the main body 1 directly in such as a manner that the protrudent ring 42 of the gas supply tube 4 can be positioned into and engaged with a recessed circular trench 13, which is formed on the inner surface of the horizontal receiving hole 11.

Referring further to FIG. 4 and FIG. 5, after the assembled spray nozzle 2, gas guide device 3, and gas supply tube 4 are positioned in the horizontal receiving hole 11 of the main body 1, the spray nozzle 2 is located in the front end of the horizontal receiving hole 11. In addition, the shaft body 31 of the gas guide device 3, which is located between the spray nozzle 2 and the gas supply tube 4, is communicated with the axial through hole 12. The gas guide device 3, which locates between the spray nozzle 2 and the gas supply tube 4, has several bumps 315 and notches 312 on both sides, respectively. The notches 312 of the shaft body 31 are designed to prevent the gas, which is supplied via the gas supply tube 4, from being blocked so that the gas can be guided into the gas hole 314 of the gas guide device 3 via the notches 312. The bumps 315 of the shaft body 31 are designed to form gaps between the action chamber 21 of the spray nozzle 2 and the liquid guide trenches 313 to allow the perfume liquid to pass therethrough. As a result, the gas, which is supplied via the gas supply tube 4, is allowed to enter the gas guide device 3 by the use of the gaps formed between the notches 312 of the gas guide device 3 and the coupling hole 41 of the gas supply tube 4. At this moment, the perfume liquid is shifted into the main body 1 by pressure. After mixing the gas with the perfume liquid, the perfume liquid is sprayed out via the gaps between the bumps 315 of the shaft body 31 of the gas guide device 3 and the action chamber 21 of the spray nozzle 2 so as to form uniform perfume mists.

By compressing the compressible ball to provide the gas supply force, the air is allowed to enter the gas supply tube 4. At this moment, the rolling ball 43 held in the gas supply tube 4 is located to lean against the notches 312 of the shaft body 31 to allow the gas to pass through the gaps between the notches 312 and the rolling ball 43 for spraying out the perfume liquid. After the perfume liquid is sprayed out, the rolling ball 43 is shifted back to block a narrow opening 411, which is formed on the back of the gas supply tube 4.

Referring further to FIG. 2 and FIG. 5, a cover 5 is integrally formed by an injection molding method. The cover 5 has a coupling part 51 and an axial through hole 52 adjacent to the coupling part 51. The through hole 52 is able to balance the internal pressure inside a perfume bottle. The coupling part 51 has a protrudent part 511 formed thereon for engaging with a positioning trench 121 inside the axial through hole 12. In addition a shaft 512 is formed on the top of the coupling part 51 for being exactly sleeved into a sleeving part 122 inside the axial through hole 12 of the main body 1 so that the assembled spray head structure 10 can be coupled with the coupling part 51. In addition, an outer cover 6 can be sleeved onto the outside of the cover 5. The cover 5 can be manufactured and processed easily since it is formed by the injection molding method. In addition, its simple structure is suitable for all kinds of spray heads and not confined to a specific spray head. As a result, the cover 5 of the present invention has greatly improved suitability even if its structure is simple.

What the invention claimed is:

1. A perfume spray head structure comprising:

a main body, a spray nozzle, a gas guide device, and a gas supply tube, which are coupled with a cover, said main body having a horizontal receiving hole and an axial through hole that communicate with each other, said spray nozzle having a recessed action chamber;

said gas guide device having a shaft body having a gas hole penetrating through the center thereof, a plurality of notches being formed on the edge of a coupling part, which is formed on one end of said shaft body, a plurality of liquid guide trenches being formed axially on the other end of said shaft body, a plurality of bumps being formed on the edge of said shaft body adjacent to said liquid guide trenches;

a coupling holes being formed on one end of said gas supply tube, a rolling ball being located in said coupling holes, a protrudent ring being formed around the outside of said coupling hole;

wherein for the purpose of assembling said perfume spray head structure, said coupling part of said shaft body of said gas guide device is mounted into said coupling hole of said gas supply tube, wherein the other end of said shaft body is partially inserted into said action chamber of said spray nozzle and said liquid guide trenches of said gas guide device is partially exposed to the outside of said action chamber, wherein said spray nozzle, said gas guide device, and said gas supply tube are assembled to the inside of said horizontal receiving hole of said main body directly to prevent the occurrence of displacement;

and a sleeve being formed by injection molding, said cover having a coupling part and a shaft formed on the top of said coupling part for coupling with said axial through hole of said main body.

2. A perfume spray head structure of claim 1, wherein said main body has a recessed circular trench formed on a wall surface of said horizontal receiving hole for being engaged with said protrudent ring of said gas supply tube.

3. A perfume spray head structure of claim 1, wherein said bumps formed on the edge of said shaft body of said gas guide device are designed for forming gaps between said action chamber of said spray nozzle and said liquid guide trenches so as to allow the perfume liquid to pass therethrough.

4. A perfume spray head structure of claim 1, wherein said notches formed on the edge of said shaft body of said gas guide device are designed for preventing said rolling ball from blocking the gas, which is supplied via said gas supply tube, so that the gas can be guided into said gas hole of said gas guide device via said notches.

* * * * *